United States Patent [19]

Martin et al.

[11] Patent Number: 4,520,176

[45] Date of Patent: May 28, 1985

[54] TEXTILE FINISHING COMPOSITIONS

[75] Inventors: Eugene R. Martin, Onsted, Mich.; David S. Ansel, Sylvania, Ohio; Paul A. Manis, Adrian, Mich.

[73] Assignee: SWS Silicones Corporation, Adrian, Mich.

[21] Appl. No.: 560,348

[22] Filed: Dec. 12, 1983

Related U.S. Application Data

[63] Continuation-in-part of Ser. No. 430,187, Sep. 30, 1982, abandoned.

[51] Int. Cl.[3] ..... C08L 61/28

[52] U.S. Cl. ..... 524/598; 8/115.6; 8/183; 8/184; 8/185; 524/262; 524/263; 524/264; 524/265; 524/266; 524/267; 524/268; 524/597; 525/515; 528/254

[58] Field of Search ..... 524/597, 598, 542, 262, 524/263, 264, 265, 266, 267, 268; 528/254; 525/515; 8/183, 184, 185, 115.6; 252/8.8

[56] References Cited

U.S. PATENT DOCUMENTS

| | | | |
|---|---|---|---|
| 3,149,999 | 9/1964 | Enders et al. | 524/598 |
| 4,200,564 | 4/1980 | Komminoth et al. | 524/598 |
| 4,300,898 | 11/1981 | North | 8/115.6 |

FOREIGN PATENT DOCUMENTS 1454504 11/1976 United Kingdom .

*Primary Examiner*—Theodore E. Pertilla

[57] ABSTRACT

A textile finishing composition comprising (1) a diluent and (2) a durable press resin composition containing (a) an aminoplast resin and (b) an aldehyde. The textile finishing composition is combined with an acid catalyst and applied to textile materials to impart softness, improved wetting properties and durable press properties.

The textile finishing composition is applied at lower than normal dry add-on levels to textile materials to provide textile materials having lower levels of formaldehyde.

15 Claims, No Drawings

TEXTILE FINISHING COMPOSITIONS

This application is a continuation-in-part of application Ser. No. 430,187, filed on Sept. 30, 1982, now abandoned.

The present invention relates to textile finishing compositions, particularly to textile finishing compositions for imparting durable press properties to treated textile materials and more particularly to a process for treating textile materials to impart durable press properties thereto.

BACKGROUND OF THE INVENTION

Durable press resins, also known as "aminoplast resins", have been described in U.S. Pat. No. 4,300,898 to North, for treating textile materials to impart durable press properties and dimensional stability to treated textile materials. These durable press resins, such as methylolated ureas or methylolated urea based derivatives which are obtained from the reaction of formaldehyde and urea or urea based derivatives generally contain 2.2 to 4.2 weight percent of formaldehyde.

Textile materials treated with the durable press resins generally release formaldehyde either present in the durable press resin and/or through the hydrolysis of unreacted methylol groups. The formaldehyde causes unpleasant odors and is a suspected health hazard. Therefore, it is preferred that textile materials finished with durable press resins be free of formaldehyde or at least have very low levels of formaldehyde and have as few as possible unreacted methylol groups.

In order to reduce the formaldehyde level on treated fabrics, scavengers such as cyclic ethylene urea, propylene urea and certain nitrogen-containing heterocyclic compounds have been employed. Also, U.S. Pat. No. 3,723,058 discloses reacting formaldehyde with phthalimide to remove the formaldehyde.

Another possible method of reducing the formaldehyde level is to apply a conventional aminoplast resin to textile materials at low levels; however, it does not give satisfactory durable press properties.

Surprisingly, it has been found that satisfactory durable press properties may be achieved if an aldehyde is added to a low level of aminoplast resin. Moreover, it has been found that the addition of the aldehyde does not substantially increase the amount of free formaldehyde on the textile materials. In addition, durable press properties can be achieved at lower costs and with less potential toxicological problems in the work environment as well as for the consumer.

Therefore, it is an object of the present invention to provide textile finishing compositions for treating textile materials. Another object of this invention is to provide textile finishing compositions which impart softening and durable press properties to textile materials. A further object of this invention is to provide a textile material having low formaldehyde levels, a soft hand, durable press properties and dimensional stability characteristics.

SUMMARY OF THE INVENTION

The foregoing objects and others which will become apparent from the following description are accomplished in accordance with this invention, generally speaking, by providing a textile finishing composition comprising (1) a diluent and (2) a durable press resin composition in an amount of at least 0.18 percent by weight based on the weight of the diluent and durable press resin composition, said durable press resin composition consisting of (a) an aminoplast resin and (b) an aldehyde, in which the weight ratio of aldehyde to aminoplast resin is from about 0.05 to 0.6. The textile finishing composition is combined with an acid catalyst and applied to textile materials to impart durable press and dimensional stability properties thereto. In addition to providing improved durable press properties and dimensional stability characteristics, the treated textile materials have a low level of formaldehyde and a soft hand.

DETAILED DESCRIPTION OF THE INVENTION

The aminoplast resins which are used in the durable press resin compositions of this invention are well known in the art. Suitable examples of aminoplast resins are the urea formaldehydes, e.g., propylene urea formaldehyde, and dimethylol urea formaldehyde; melamine formaldehyde, e.g., tetramethylol melamines, and pentamethylol melamines; ethylene ureas, e.g., dimethylol ethylene urea, dihydroxy dimethylol ethylene urea, ethylene urea formaldehyde, hydroxy ethylene urea formaldehyde; carbamates, e.g., alkyl carbamate formaldehydes; formaldehyde-acrolein condensation products; formaldehyde-acetone condensation products; alkylol amides, e.g., methylol formamide, methylol acetamide; acrylamides, e.g., N-methylol acrylamide, N-methylol methacrylamide, N-methylol-N-methacrylamide, N-methylmethylol acrylamide, N-methylol methylene-bis(acrylamide), methylene-bis(N-methylol acrylamide); chloroethylene acrylamides; diureas, e.g., trimethylol acetylene diurea, tetramethylol-acetylene diurea; triazones. e.g., dimethylol-N-ethyl triazone, N,N'-ethylene-bis dimethylol triazone, halotriazones; haloacetamides, e.g., N-methylol-N-methylchloroacetamide; urons, e.g., dimethylol uron, dihydroxy dimethylol uron; and the like.

Other aminoplast resins which may be used in the compositions of this invention may be represented by the formulas:

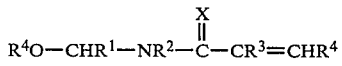

(1)

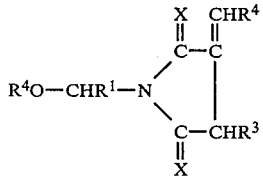

(2)

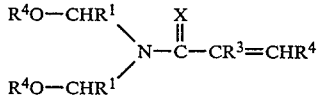

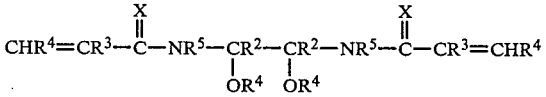

(4)

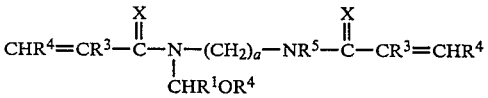

(5)

-continued

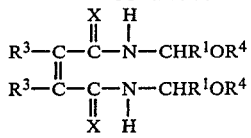

(6)

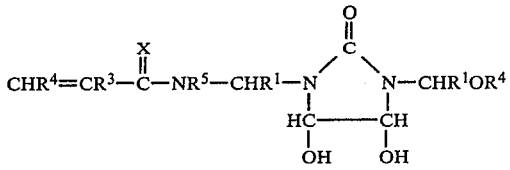

(7)

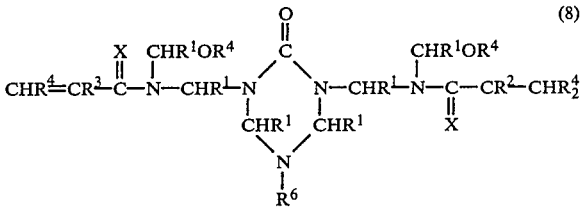

(8)

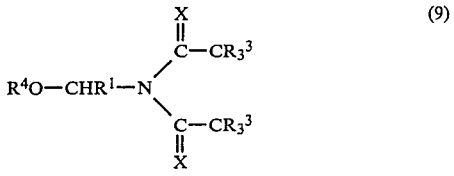

(9)

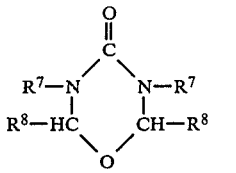

(10)

wherein $R^1$ is hydrogen, a lower alkyl radical or a radical from a saturated or unsaturated aldehyde, $R^2$ is hydrogen, a lower alkyl radical or a radical represented by the formula

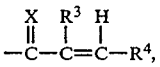

$R^3$ is hydrogen or a methyl radical, $R^4$ is hydrogen or a lower alkyl radical, $R^5$ is hydrogen, a lower alkyl radical or $CHR^1OR^4$, with at least one $R^5$ being $CHR^1OR^4$, $R^6$ is a lower alkyl radical or hydroxy alkyl radical, $R^7$ is hydrogen, hydroxy radical, or lower alkyl radical, $R^8$ is hydrogen, a lower alkyl radical, an alkanol radical, or an alkenol radical, X is oxygen or sulfur, and a is a number of from 1 to 6. Sulfur containing groups such as

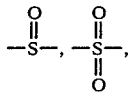

or sulfonium radical may be substituted for the

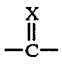

group. Mixtures of two or more aminoplast resins may be employed in the compositions of this invention.

Suitable examples of aldehydes which may be used in the compositions of this invention are saturated and unsaturated aliphatic aldehydes having from 1 to 20 carbon atoms, such as formaldehyde, ethanal, propanal, propenal, propynal; isomers of butanal, pentanal, hexanal, heptanal, octanal, nonanal, decanal, undecanal, dodecanal, tridecanal, tetradecanal, pentadecanal, hexadecanal, heptadecanal, octadecanal, nonadecanal, ecosanal, butenal, hexenal, undecenal, furfural and the like. Other examples of substituted saturated and unsaturated aldehydes having from 1 to 20 carbon atoms are haloalkanals, such as chloroethanal, dichloroethanal, bromal, chloral, 2-bromopropanal, 2-chloropropanal, 3-chloropropanal, 2-chloro-2-methylpropanal, 2,3-dibromopropanal, 2,3-dichloropropanal, 2,2,3-trichloropropanal, 4-chlorobutanal, 2,3-dichlorobutanal, 2,2,3-trichlorobutanal and the like; hydroxyalkanals such as glycolaldehyde, 2,3-dihydroxypropanal, 3-hydroxybutanal, 4-hydroxypentanal, 3-hydroxy-2-methylpentanal and the like; alkylalkanals such as 2,2-dimethylpropanal, 2-ethylbutanal, 2-methylbutanal, 3-methylbutanal, 2-ethylhexanal, and the like; alkoxyalkanals such as ethoxyethanal, methoxyethanal and the like; oxoalkanals such as glyoxal, methylglyoxal, 2-phenoxypropanal, 4-methyl-2-oxopentanal, 2-oxopentanal, 4-oxopentanal and the like; haloalkenals such as 2-chloropropenal, 2-chlorobutenal and the like; and alkoxyalkenals such as 3-ethoxybutenal. Examples of aromatic substituted or unsubstituted aldehydes are benzaldehyde, tolualdehydes, salicylaldehyde, 1-phenylpropynal, 2-benzylidenebutanal, 2-benzylideneheptanal, hydroxybenzaldehydes, anisaldehyde, vanillin, piperanal, cinnamaldehyde, carboxybenzaldehydes and the like.

Diluents which are employed in the textile finishing compositions of this invention are water and aliphatic alcohols having up to 8 carbon atoms. Examples of suitable aliphatic alcohols are methanol, ethanol, propanol, butanol, hexanol and octanol.

The amount of durable press resin composition present in the textile finishing composition is not critical and may range from about 0.18 percent by weight up to about 72 percent by weight and more preferably from about 0.2 percent by weight to about 65 percent by weight based on the weight of the diluent and the durable press resin composition.

Preferably, the weight ratio of aldehyde to aminoplast resin present in the durable press resin composition ranges from about 0.05 to 0.6 and more preferably from about 0.1 to about 0.5.

The amount of diluent present in the textile finishing composition may range from about 99.82 to 28 percent by weight and more preferably from about 99.8 to 35 percent by weight based on the weight of the diluent and the durable press resin composition.

A softening agent or softener may be incorporated in the textile finishing compositions of this invention to impart a soft hand to textile materials treated therewith. The term "softening agent" or "softener" includes any material which may be combined with the composition of this invention to impart a soft hand to treated textile materials.

Softeners which may be added to the compositions of this invention are well known in the art. Examples of suitable softeners are organopolysiloxanes which are capable of being crosslinked. The crosslinkable organopolysiloxane compositions contain organopolysiloxanes having the general formula $$HO(\overset{\overset{R^9}{|}}{\underset{\underset{R^9}{|}}{Si}}O)_bH$$

and a crosslinking agent such as a silane having the general formula $$R^9_mSi(Y)_{4-m}$$

or siloxanes having —Si—O—Si— linkages and the remaining valences of the silicon atoms are satisfied by $R^9$ and Y, in which $R^9$ is a monovalent hydrocarbon radical having up to 18 carbon atoms and Y is a hydrolyzable group, such as an acyloxy, oximo, alkoxy, aryloxy, halogen, aminoxy, amido or phosphato group, in which the siloxanes have an average of at least 3 hydrolyzable groups per molecule, b is a number of from 1 to 1000, and m is 0 or 1.

Catalysts such as metallic salts of carboxylic acid may be used with the organopolysiloxanes to promote crosslinking. Examples of suitable salts are carboxylic acid salts of tin, zirconium or titanium. Specific examples of suitable catalysts are dibutyltin dilaurate, tin octoate, tin oleate and the like.

Further examples of softening agents which may be added to the compositions of this invention are noncrosslinkable polydiorganosiloxanes having the general formula $$R^9_3SiO(\overset{\overset{R^9}{|}}{\underset{\underset{R^9}{|}}{Si}}O)_bSiR^9_3$$

in which $R^9$ and b are the same as above.

Other softening agents which may be used in the compositions of this invention are those obtained from the addition of organopolysiloxanes having silicon-bonded hydrogen atoms to organopolysiloxanes having silicon-bonded aliphatically unsaturated groups. Organopolysiloxanes containing silicon-bonded hydrogen may be represented by the general formula $$R^9_eH_fSiO_{\frac{4-e-f}{2}}$$

in which $R^9$ is the same as above, e has a value of from 1.0 to 2.5, f has a value of from 0.005 to 2.0 and the sum of e+f is equal to from 1.005 to 3.0.

The organopolysiloxanes containing silicon-bonded hydrogen may also be copolymers containing an average of at least one unit per molecule of the formula $$R^9_{e'}H_fSiO_{\frac{4-e'-f}{2}}$$

with the remaining siloxane units of the organopolysiloxane having the average formula $$R^9_eSiO_{\frac{4-e}{2}}$$

where $R^9$ and e are the same as above, e' has a value of from 0 to 2, f' has a value of from 1 to 2, and the sum of e'+f' is equal to from 1.0 to 3.0.

Generally, the copolymers contain from 0.5 to 99.5 mole percent of siloxane units of the formula $$R^9_{e'}H_fSiO_{\frac{4-e'-f}{2}}$$

and from 0.5 to 99.5 mole percent of siloxane units of the formula $$R^9_eSiO_{\frac{4-e}{2}}$$

where $R^9$, e, e' and f' are the same as above.

The organopolysiloxanes containing silicon-bonded aliphatically unsaturated groups may be represented by the formula $$R^9_eR^{10}_fSiO_{\frac{4-e-f}{2}}$$

where $R^9$, e and f are the same as above and $R^{10}$ represents a silicon-bonded aliphatically unsaturated group such as a vinyl or allyl radical. These organopolysiloxanes containing aliphatically unsaturated groups may also be copolymers having siloxane units of the formula $$R^9_{e'}R^{10}_fSiO_{\frac{4-e'-f}{2}}$$

where $R^9$, $R^{10}$, e', f' and the sum of e'+f' are the same as above.

Generally, the copolymers contain from 0.5 to 99.5 mole percent of units having the formula $$R^9_{e'}R^{10}_fSiO_{\frac{4-e'-f}{2}}$$

and from 0.5 to 99.5 mole percent of units having the formula $$R^9_eSiO_{\frac{4-e}{2}}$$

where $R^9$, $R^{10}$, e, e' and f' are the same as above.

Any catalyst capable of promoting the addition of silicon-bonded hydrogen to silicon-bonded aliphatically unsaturated groups may be used in preparing these softeners. Preferably, the catalyst is platinum or a platinum compound or complex.

The silicone softeners may also contain other functional groups. Examples of such softeners are copolymers of aminofunctional polysiloxanes containing units of the formula $$NH_2—R^{11}—(NHR^{11})_{\overline{g}}SiO_{1.5}$$

and units of the formula $$R^{10}_eSiO_{\frac{4-e}{2}}$$

wherein $R^{10}$ and e are the same as above, $R^{11}$ which may be the same or different is a divalent hydrocarbon radical having from 1 to 10 carbon atoms and g=0, 1, or 2.

Other softeners which may be used are copolymers of ureidofunctional polysiloxanes having units of the formula $$H_2N-\overset{\overset{\displaystyle O}{\|}}{C}-NH-R^{11}-SiO_{1.5}$$

and units of the formula $$R^9_eSiO_{\frac{4-e}{2}}$$

where $R^9$ and $R^{11}$ are the same as above.

Softeners containing mercaptofunctional groups such as mercaptofunctional polysiloxanes having units of the formula $$(H-S-R^{11})_hSiO_{1.5}$$

and units of the formula $$R^9_eSiO_{\frac{4-e}{2}}$$

may be employed, where $R^9$, $R^{11}$ and e are the same as above and h is a number of from 1 to 3.

Suitable examples of monovalent hydrocarbon radicals represented by $R^9$ are alkyl radicals having from 1 to 18 carbon atoms such as methyl, ethyl, propyl, isopropyl, butyl, amyl, hexyl, octyl, decyl, dodecyl, and octadecyl; alkenyl radicals having from 1 to 18 carbon atoms such as vinyl, allyl, butenyl, butadienyl, 1-pentenyl, 1-decenyl, and 1-octadecenyl; aryl radicals such as phenyl, napthyl, and anthryl; aralkyl radicals such as phenylmethyl, phenylethyl, or phenylpropyl, or alkaryl radicals such as tolyl, xylyl, ethylphenyl; hydroxy and carboxy substituted hydrocarbon radicals such as hydroxyphenyl, carboxyphenyl, hydroxybenzyl, carboxybenzyl, hydroxytolyl and hydroxyxylyl, carboxytolyl and carboxyxylyl radicals.

Specific examples of divalent radicals represented by $R^{11}$ are ethylene, propylene, butylene, hexylene, octylene, decylene, ethenylene, propenylene, 1-butenylene, 2-butenylene, cyclohexylene, 3-cyclohexen-1,2-xylene and naphthenylene.

Other organofunctional silicone softeners which may be included in the compositions of this invention are the silylated polyethers described in U.S. Pat. Nos. 4,312,993 and 4,331,797 to Martin which are incorporated herein by reference.

Also, compositions containing silanol terminated polyorganosiloxanes and the silylated polyethers described in U.S. Pat. Nos. 4,312,993 and 4,331,797 to Martin can be used as softeners in the compositions of this invention.

Another class of silicone softeners which may be included in the textile finishing compositions of this invention are those described in U.S. Pat. No. 4,184,004 to Pines, which is incorporated herein by reference. These softeners consist of organosilicone terpolymers containing a plurality of reactive epoxy groups and a plurality of polyoxyalkylene groups. These organosilicone terpolymers may be prepared by the platinum catalyzed addition of an ethylenically unsaturated epoxy compound and an ethylenically unsaturated polyoxyalkylene organic radical free of olefinic unsaturation.

Organic softening agents may also be used in the textile finishing compositions of this invention in the presence or absence of the above silicone softeners. Suitable examples of organic softeners are fatty amides, fatty acid amines, and fatty acid amido amines; amido amines with mono- and diglycerides, quaternized ethoxylated fatty acid amines, hydroxyethyldiethylammonium sulfate and stearic quaternary ammonium compounds; fatty acid esters such as stearates, glycerol stearates, diethylene glycol stearates, and sulfonated fatty acid esters of polyethylene glycols and diethylene glycols; oxyalkylene polymers such as oxyethylene polymers, oxypropylene polymers, and copolymers thereof, salts of long-chain alcohols and fatty alcohol/fatty acid amide blends; fatty acids such as lauric, myristic, palmitic, oleic, and stearic acids; diethylene dipropyl benzoates; polyethylene polymers and sodium hydrocarbon sulfates. The softening agent may be added directly to te textile finishing compositions, or they may be emulsified or dissolved in water or organic solvents and then added to the finishing compositions.

When the softening agent is added to the textile finishing compositions, it is preferred that it be present in an amount such that the resultant finishing bath used for treating textile materials will contain from about 0 to about 8 parts by weight of softening agent per 100 parts by weight of finishing composition. The softening agent may be dissolved in aliphatic alcohols such as methanol, ethanol, butanol, hexanol and octanol.

The textile finishing compositions of this invention may be prepared by mixing the diluent with the durable press resin composition, i.e., aminoplast resin and aldehyde, in any order and at temperatures ranging from about 10° to 90° C.

The textile finishing compositions may be applied to any textile materials. Examples of suitable textile materials are cotton, rayon, polyester, polypropylene, polyethylene, polyurethane, polyamide, wool, hemp, natural silk, cellulose acetate and polyacrylonitrile fibers as well as mixtures of these fibers. The textile materials may consist of staple or monofilament fibers and fabrics made thereof.

The textile finishing compositions of this invention may be applied to the textile materials by any means known in the art, such as by spraying, immersion, foaming, padding, calendering or by gliding the fibers across a base which has been saturated with the compositions of this invention.

A preferred method for treating textile materials is to use a finishing bath containing a solution, dispersion or emulsion of the textile finishing compositions, i.e., durable press resin composition, diluent, acid catalyst and softener, if desired. Also, the finishing bath composition may be further diluted with the same diluent or at least a diluent which is compatible with the diluent used in the textile finishing composition. Preferably, the additional diluent is water or an aliphatic alcohol having from 1 to 8 carbon atoms.

The finishing bath preferably contains from 0.1 to about 99 parts by weight, and more preferably from about 5 to 50 parts by weight of the textile finishing composition and from about 1 to 10 parts by weight of acid catalyst per 100 parts by weight of finishing composition. The amount of additional diluent added to the finishing bath may range from 0 to 99.4 parts by weight and more preferably from about 10 to 75 parts by weight per 100 parts by weight of finishing composition and the amount of softening agent, when present, may range from about 0 to about 8 parts by weight and more preferably from about 1 to 5 parts by weight per 100 parts by weight of finishing composition.

When the textile finishing compositions are used in the form of an emulsion, any of the known surfactants can be used as emulsifying agents, including the anionic, cationic, nonionic and amphoteric surfactants.

Suitable examples of acid catalysts which may be used in the finishing bath are water soluble metal salts such as magnesium chloride, magnesium nitrate, magnesium sulfate, magnesium dihydrogen phosphate, zinc nitrate, zinc chloride, zinc tetrafluoroborate, aluminum chlorohydrate, aluminum chloride and mixtures of two of the above salts; water soluble ammonium and amine salts such as ammonium chloride, ammonium sulfate, aminomethylpropanol hydrochloride and aminomethylpropanol nitrate; ammonium and amine salts in combination with the metal salts described above; acids such as oxalic acid, gluconic acid, phosphoric acid, tartaric acid, maleic acid, p-toluenesulfonic acid and acetic acid; and combinations of the above acids with the above described metal salts.

The aminoplast resin component and the water soluble acid catalyst component should be kept separate until ready for use due to the instability of the mixture. The other components of this invention may be combined together in any order. It is, however, preferred that the other components be added to the aminoplast resin component.

The amount of the textile finishing composition of this invention which is applied to the textile material depends on the desired properties of the treated material. Generally, it is preferred that the textile material be treated with from about 0.1 to 25 percent by weight of textile finishing composition, and more preferably from about 0.2 to 20 percent by weight of the textile finishing composition, based on the weight of the textile material.

The textile material treated with the composition of this invention is heated at an elevated temperature, e.g., from about 80° to 200° C. for a brief period of time; e.g., from about 20 seconds to about 15 minutes. Alternatively, the treated textile material can be dried below the above temperature range, e.g., from about 50° to 95° C. for a brief period of time, e.g., from 1 to 10 minutes, and then cured at an elevated temperature, e.g., from 125° to 200° C. for a even briefer period of time, e.g., 15 to 60 seconds.

Textile materials treated with the finishing compositions of this invention exhibit dimensional stability and good durable press properties which are common to textile materials treated heretofore with aminoplast resins. The addition of the aldehyde in the present invention, however, permits a reduction of the aminoplast resin component of from 57 to 95 percent without adversely increasing the amount of formaldehyde present on the treated textile material, and without affecting the durable press properties and dimensional stability characteristics. Heretofore, when the level of aminoplast resin was reduced in conventional systems, in order to lower the formaldehyde levels on the treated fabric, poor durable press properties and dimensional stability characteristics were observed.

The addition of softener to the textile finishing compositions of this invention does not alter the durable press properties and dimensional stability characteristics of the fabric nor formaldehyde levels on the treated textile material. Textile materials treated with the textile finishing compositions of this invention containing softener have a softer hand than those treated with the textile finishing compositions alone or with other conventional aminoplast resins. Furthermore, because the amount of aminoplast resin component required in the present invention to obtain durable press properties is significantly less than that required heretofore, the textile finish is significantly more economical.

Other substances which may be incorporated in the compositions of this invention are agents which improve abrasion resistance of the treated fibers, materials which improve the fragrance of the treated textile materials, antistatic agents, lubricants, fire retardant agents, soil resistant materials, other hydrophilic, oleophilic, or hydrophobic agents and soil release materials such as those described in U.S. Pat. Nos. 3,595,141 and 3,377,249 to Marco.

Specific embodiments of this invention are further illustrated in the following examples in which all parts and percentages are by weight unless otherwise specified. The amount of formaldehyde present on the treated textile materials is determined in accordance with the procedure described in the Technical Manual of the American Association Of Textile Chemists And Colorists (AATCC—Test No. 112–1978). The dimensional stability and durable press ratings are determined in accordance with AATCC test method number 135–1978 and 124–1978, respectively.

EXAMPLE 1

Several compositions are prepared by dispersing the ingredients shown in Table I in water. The compositions are padded onto samples of polyester/cotton (65/35) fabric at 50 percent wet pick-up. The fabric is dried for 60 seconds at 120° and cured for 20 seconds at 204° C. The treated fabric is then evaluated for (a) parts per million formaldehyde; (b) dimensional stability after five home launderings; and (c) durable press properties after five home launderings.

The results show that formaldehyde enhances the durable press ratings and dimensional stability of the fabric through multiple home launderings. In addition, the treated fabric contained less than 200 ppm (parts per million) formaldehyde. Generally, the textile industry requires 500 ppm or less. Furthermore, when the compositions of this invention are compared with a conventional finishing bath containing 6.75 parts of dimethyloldihydroxyethyleneurea resin, equivalent durable press properties and dimensional stability characteristics are obtained with lower parts per million (ppm) of formaldehyde being present on the treated fabric.

TABLE I

| Dimethylol-dihydroxy-ethylene-ure (A) (Parts) | Formal-dehyde in (A) (B) (Parts) | Formal-dehyde added to (A) (C) (Parts) | Total Formal-dehyde (B + C) (Parts) | Ratio Formal dehyde to Di-hydroxy-ethylene-urea (B + C)/A | Magnesium Chloride-Aluminum Chloride (9:1) (Parts) | Zinc Nitrate (Parts) | Water (Parts) | Fifth Wash Durable Press Rating | Fifth Wash Dimensional Stability Warp (Percent) | Fill (Percent) | Parts Per Million Formalde-hyde on treated fabric |
|---|---|---|---|---|---|---|---|---|---|---|---|
| 0.9 | 0.02 | 0.185 | 0.205 | 0.228 | 0.9 | — | 98.00 | 3.5 | −1.3 | −0.6 | 168 |
| 0.9 | 0.02 | 0.185 | 0.205 | 0.228 | — | 1.5 | 97.40 | 3.5 | −1.6 | −0.5 | 48 |
| Comparison Examples | | | | | | | | | | | |
| — | — | — | — | — | — | — | 100.00 | 3 | −2.8 | −0.5 | 12 |
| 6.75 | 0.15 | — | 0.15 | 0.022 | 0.9 | — | 92.20 | 3.5 | −1.3 | −0.1 | 275 |
| 0.9 | 0.02 | — | 0.02 | 0.022 | 0.9 | — | 98.18 | 3 | −1.8 | −0.6 | 76 |

EXAMPLE 2

Several compositions are prepared by dispersing the ingredients listed in Table II in water. These compositions are padded onto polyester/cotton (65/35) fabric at 50 percent wet pick-up. The fabric is dried and cured in accordance with the procedure described in Example I. The treated fabric is then evaluated for (a) parts per million formaldehyde; (b) dimensional stability after five home launderings; and (c) durable press properties after five home launderings.

The results show that the presence of formaldehyde in a durable press finish composition enhances the durable press ratings and dimensional stability of the fabric after multiple home launderings while remaining below 500 ppm of formaldehyde.

TABLE II

| 2-Methoxy carbamate resin (A) (Parts) | Alkylated urea-Formaldehyde resin (A) (Parts) | Formalde-hyde in (A) (B) (Parts) | Formalde-hyde added to (A) (C) (Parts) | Total Formal-dehyde (B + C) (Parts) | Ratio Formal-dehyde to resin (B + C)/A | Magnesium Chloride-Aluminum Chloride (9:1) (Parts) | Water (Parts) | Fifth Wash Durable Press Rating | Fifth Wash Dimensional Stability Warp (Percent) | Fill (Percent) | Parts Per Million Formalde-hyde on treated fabric |
|---|---|---|---|---|---|---|---|---|---|---|---|
| — | 0.96 | 0.018 | 0.185 | 0.203 | 0.211 | 0.9 | 97.94 | 3.5 | −1.4 | −0.3 | 336 |
| 0.92 | — | 0.030 | 0.185 | 0.215 | 0.234 | 0.9 | 97.96 | 3.5 | −1.6 | −0.5 | 66 |
| Comparison Examples | | | | | | | | | | | |
| — | — | — | — | — | — | — | 100.0 | 3.0 | −2.8 | −0.5 | 12 |
| — | 0.96 | 0.018 | — | 0.018 | 0.019 | 0.9 | 98.12 | 3.5 | −1.8 | −0.6 | 105 |
| 0.92 | — | 0.030 | — | 0.030 | 0.033 | 0.9 | 98.15 | 3.0 | −1.8 | −0.7 | 44 |

EXAMPLE 3

Several compositions are prepared by dispersing the ingredients listed in Table III in water. These compositions are padded onto polyester/cotton (65/35) fabric at 50 percent wet pick-up. The fabric is dried and cured in accordance with the procedure described in Example 1. The treated fabric is then evaluated for (a) parts per million residual formaldehyde; (b) dimensional stability after five home launderings; and (c) durable press properties after five home launderings.

The results show that aldehydes enhance the durable press ratings and dimensional stability of the fabric after multiple home launderings while the formaldehyde levels are acceptable to the textile industry. The comparison example shows that when the aminoplast resin is used alone at low levels, it gives inferior durable press ratings and only marginal dimensional stability. Generally, a durable press rating of 3.5 and a dimensional stability of less than 2 percent shrinkage for a 65/35 polyester/cotton fabric is acceptable to the textile industry.

TABLE III

| Di-methylol-dihydroxy-ethylene urea (A) (Parts) | Formal-dehyde in (A) (B) (Parts) | Formal-dehyde added to (A) (C) (Parts) | Acetal-dehyde added to (A) (C) (Parts) | Pro-pional-added to (A) (C) (Parts) | Total Aldehyde (B + C) (Parts) | Ratio Aldehyde to Di-methylol-dihydroxy-ethylene-urea (B + C)/A | Magnesium Chloride-Aluminum Chloride (9:1) (Parts) | Water (Parts) | Fifth Wash Durable Press Rating | Fifth Wash Dimensional Stability Warp (Percent) | Fill (Percent) | Parts Per Million Formalde-hyde on treated fabric |
|---|---|---|---|---|---|---|---|---|---|---|---|---|
| 0.9 | 0.02 | 0.185 | — | — | 0.205 | 0.228 | 0.9 | 98.00 | 3.5 | −1.4 | −0.2 | 101 |
| 0.9 | 0.02 | 0.244 | — | — | 0.264 | 0.293 | 0.9 | 97.94 | 3.5 | −1.4 | −0.5 | 106 |
| 0.9 | 0.02 | — | 0.185 | — | 0.205 | 0.228 | 0.9 | 98.00 | 3.5 | −1.5 | −0.5 | 59 |
| 0.9 | 0.02 | — | — | 0.194 | 0.214 | 0.238 | 0.9 | 97.99 | 3.5 | −1.8 | −0.5 | 215 |
| Comparison Examples | | | | | | | | | | | | |
| — | — | — | — | — | — | — | — | 100.00 | 3.0 | −2.8 | −0.5 | 12 |
| 0.9 | 0.02 | — | — | — | 0.020 | 0.022 | 0.9 | 98.18 | 3.0 | −1.8 | −0.6 | 76 |

EXAMPLE 4

Several bath compositions are prepared by dispersing the ingredients listed in Table IV in a water-ethanol solvent. These formulations are padded onto polyester/cotton (65/35) fabric at a 30 percent wet pick-up.

The fabric is dried and cured in accordance with the procedure described in Example 1. The treated fabric is then evaluated for (a) parts per million formaldehyde; (b) dimensional stability after five home launderings; and (c) durable press properties after five home launderings.

The results show that the presence of an aromatic aldehyde in a water-ethanol solvent system will improve the durable press ratings and dimensional stability of the fabric after multiple home launderings. Also, the data indicates that the dimethyloldihydroxyethyleneurea contributes to the increased formaldehyde level.

The treated fabric is then evaluated for (a) parts per million formaldehyde; (b) dimensional stability after five home launderings; (c) durable press properties after five home launderings; and (d) fabric hand.

The results show that the presence of formaldehyde in a durable press finishing composition containing dimethyloldihydroxyethyleneurea improves the durable press ratings and dimensional stability of the fabric after multiple home launderings while the formaldehyde level is less than 300 ppm. In addition, the presence of the softener has no effect on the amount of formaldehyde present on the fabric, nor the durable press properties and dimensional stability characteristics of the fabric after multiple launderings. Furthermore, all fabrics treated with softeners have a soft, silky hand. The results are shown in Table VI.

TABLE IV

| Dimethyloldihydroxyethylene urea (A) (Parts) | Formaldehyde in (A) (B) (Parts) | Salicylaldehyde added to (A) (C) (Parts) | Total Aldehyde (B + C) (Parts) | Ratio Aldehyde to Dimethyloldihydroxy ethylene urea (B + C)/A | Magnesium Chloride-Aluminum Chloride (9:1) (Parts) | Water (Parts) | Ethanol (Parts) | Fifth Wash Durable Press Rating | Fifth Wash Dimensional Stability Warp (Percent) | Fill (Percent) | Parts Per Million Formaldehyde on treated fabric |
|---|---|---|---|---|---|---|---|---|---|---|---|
| 0.9 | 0.02 | 0.185 | 0.205 | 0.228 | 0.9 | 3.80 | 94.2 | 3.5 | −1.85 | −0.3 | 132 |
| Comparison Examples | | | | | | | | | | | |
| — | — | — | — | — | — | 100.00 | — | 3.0 | −2.8 | −0.5 | 12 |
| — | — | — | — | — | — | 5.5 | 94.5 | 3.0 | −2.8 | −0.5 | 5 |
| 0.9 | 0.02 | — | 0.02 | 0.022 | 0.9 | 3.68 | 94.5 | 3.0 | −1.9 | −0.1 | 129 |

EXAMPLE 5

Several compositions are prepared by dispersing the ingredients of Table V in water. These compositions are padded onto 100 percent cotton at a 50 percent wet pick-up. The fabric is dried and cured in accordance with the procedure described in Example 1. The treated fabric is then evaluated for (a) parts per million formaldehyde; (b) dimensional stability after five home launderings; and (c) durable press properties after five home launderings.

The results show that a durable press composition containing formaldehyde and dimethyloldihydroxyethyleneurea substantially improves the dimensional stability and durable press properties of 100 percent cotton as compared with a durable press composition containing only dimethyloldihydroxyethyleneurea.

The softeners employed in Examples 6(a) to (e) are prepared in the following manner:

(a) A 33 percent aqueous emulsion of a softener is prepared by heating a mixture containing 124 parts of succinic anhydride and 2,278 parts of oxyethylene-oxypropylene triol copolymer, having a molecular weight of 6360 and a weight ratio of oxyethylene to oxypropylene of 7 to 3 at 120° C. for eighteen hours in a reaction vessel. The resultant product is a yellow liquid having a viscosity of 4,168 cs. at 25° C. and an acid content of 0.58 milliequivalents per gram (theoretical 0.5 me/g).

The resultant product is mixed with 238 parts by weight of aminopropyltriethoxysilane at 70° C. for 3.0 hours. This reaction product is a yellow liquid having a viscosity of about 30,000 cs. at 25° C. The reaction product is mixed with 660 parts by weight of hydroxy terminated polydimethylsiloxane at 50° C. for 6 hours. The resultant product is a white, opaque fluid having a viscosity of 1,500,000 cs. at 25° C. The product is then

TABLE V

| Dimethyloldihydroxyethylene urea (A) (Parts) | Formaldehyde in (A) (B) (Parts) | Formaldehyde added to (A) (C) (Parts) | Total Formaldehyde (B + C) (Parts) | Ratio Formaldehyde to Dimethyloldihydroxy ethyleneurea (B + C)/A (Parts) | Magnesium Chloride-Aluminum Chloride (9:1) (Parts) | Water (Parts) | Fifth Wash Durable Press Rating | Fifth Wash Dimensional Stability Warp (Percent) | Fill (Percent) | Parts Per Million Formaldehyde on treated fabric |
|---|---|---|---|---|---|---|---|---|---|---|
| 1.80 | 0.04 | 0.185 | 0.225 | 0.125 | 1.2 | 96.78 | 2 | −1.8 | +0.4 | 247 |
| 2.25 | 0.05 | 0.092 | 0.142 | 0.063 | 1.2 | 96.41 | 2 | −1.85 | +0.4 | 192 |
| 2.25 | 0.05 | 0.185 | 0.235 | 0.104 | 1.2 | 96.32 | 2 | −1.6 | +0.1 | 374 |
| Comparison Examples | | | | | | | | | | |
| — | — | — | — | — | — | 100.0 | 1 | −6.45 | +0.35 | 4 |
| 1.80 | 0.04 | — | 0.04 | 0.022 | 1.2 | 96.96 | 2 | −2.0 | +0.25 | 103 |
| 2.25 | 0.05 | — | 0.05 | 0.022 | 1.2 | 96.54 | 2 | −2.0 | +0.2 | 357 |

EXAMPLE 6

Several compositions are prepared by dispersing the ingredients listed in Table VI in water. These compositions are padded onto polyester/cotton (65/35) fabric at 50 percent wet pick-up. The fabric is dried and cured in accordance with the procedure described in Example 1.

combined with 6,700 parts by weight of water. A white, opaque emulsion having a viscosity of 50 cs. at 25° C. is obtained.

(b) An aqueous emulsion consisting of 16 percent of the polymer prepared in (a) and 25 percent of a polysiloxane represented by the formula $$CH_3Si[(OSi)_3OCH_3]_3.$$

(c) A 33 percent aqueous solution of a polymer is prepared by heating a mixture containing 150 parts of succinic anhydride and 2880 parts of oxyethylene-oxypropylene triol copolymer, having a molecular weight of 6360 and a weight ratio of oxyethylene to oxypropylene of 7 to 3, for eighteen hours at 120° C. The product is a yellow liquid having a viscosity of 4,168 mPa.s at 25° C., and an acid content of 0.58 milliequivalents per gram (theoretical 0.5 me/g).

The resultant product is then mixed with 300 parts of aminopropyltriethoxysilane and heated at 70° C. for 2 hours. The product is a yellow liquid having a viscosity of about 30,000 mPa.s at 25° C. The resultant product is then mixed with 6670 parts of water to form a clear, straw-colored solution having a viscosity of 50 mPa.s at 25° C.

(d) A 25 percent active aqueous emulsion of a fatty acid condensation product. (Ceranine HCA—available from Sandoz Colors and Chemicals).

(e) A 33 percent aqueous solution of a polymer is prepared by heating a mixture containing 124 parts of succinic anhydride, 930 parts of oxyethylene diol having a molecular weight of 1500 at 120° C. for eighteen hours in a reaction vessel. The resultant product is a yellow liquid having an acid content of 1.2 milliequivalents per gram.

The resultant product is mixed with 374 parts of aminopropyltriethoxysilane at 70° C. for 3.0 hours. The reaction product is then mixed with 2702 parts of water. A clear, straw-colored solution is obtained.

TABLE VI

| Softener Example 6 | (Parts) | Dimethyloldihydroxyethyleneurea (A) (Parts) | Formaldehyde in (A) (B) (Parts) | Formaldehyde added to (A) (C) (Parts) | Total Formaldehyde (B + C) (Parts) | Ratio Formaldehyde to Dimethyloldihydroxyethyleneurea (B + C)/A | Magnesium Chloride-Aluminum Chloride (9:1) (Parts) | Water (Parts) | Fifth Wash Durable Press Rating | Fifth Wash Dimensional Stability (Percent) Warp | Fill | Part Per Million Formaldehyde on treated fabric |
|---|---|---|---|---|---|---|---|---|---|---|---|---|
| (a) | 0.99 | 0.9 | 0.02 | 0.185 | 0.205 | 0.228 | 0.9 | 97.00 | 3.5 | −1.5 | −0.4 | 88 |
| (b) | 0.96 | 0.9 | 0.02 | 0.185 | 0.205 | 0.228 | 0.9 | 97.04 | 3.5 | −1.4 | −0.3 | 85 |
| (c) | 0.99 | 0.9 | 0.02 | 0.185 | 0.205 | 0.228 | 0.9 | 97.00 | 3.5 | −1.8 | −0.6 | 294 |
| (d) | 1.17 | 0.9 | 0.02 | 0.185 | 0.205 | 0.228 | 0.9 | 96.82 | 3.5 | −1.4 | −0.3 | 201 |
| (a) | 6.01 | 0.9 | 0.02 | 0.185 | 0.205 | 0.228 | 0.9 | 91.98 | 3.5 | −1.6 | −0.4 | 277 |
| (e) | 0.82 | 0.9 | 0.02 | 0.185 | 0.205 | 0.228 | 0.9 | 97.18 | 3.5 | −1.5 | −0.5 | 150 |
| Comparison Examples | | | | | | | | | | | | |
| — | — | — | — | — | — | — | — | 100.00 | 3.0 | −2.8 | −0.5 | 12 |
| — | — | 0.9 | 0.02 | — | 0.02 | 0.022 | 0.9 | 98.18 | 3.0 | −1.8 | −0.6 | 76 |
| (a) | 0.99 | 0.9 | 0.02 | — | 0.02 | 0.022 | 0.9 | 97.19 | 3.0 | −1.9 | −0.55 | 79 |
| — | — | 0.9 | 0.02 | 0.185 | 0.205 | 0.228 | 0.9 | 98.00 | 3.5 | −1.3 | −0.6 | 168 |

EXAMPLE 7

Several compositions are prepared by dispersing the ingredients shown in Table VII in water. The softener is prepared in accordance with the procedure described in Example 6(a). These compositions are padded onto samples of polyester/cotton (65/35) fabric at a 50 percent wet pick-up. The fabric is dried and cured in accordance with the procedure described in Example 1. The treated fabric is then evaluated for (a) parts per million formaldehyde; (b) dimensional stability after five home launderings; (c) durable press properties after five home launderings; and (d) fabric hand. The results of these evaluations indicate that the presence of formaldehyde in a finishing bath containing varying levels of dimethyloldihydroxyethyleneurea enhance the durable press ratings and dimensional stability of the fabric after multiple home launderings while having less than 300 parts per million of formaldehyde. In addition, the presence of softener has no effect on the amount of formaldehyde present on the fabric nor the durable press ratings and dimensional stability characteristics of the fabric after multiple launderings. Furthermore, all fabrics treated with softeners have a soft, silky hand. The results are shown in Table VII.

TABLE VII

| Softener Example 6(a) (Parts) | Dimethyloldihydroxyethyleneurea (A) (Parts) | Formaldehyde in (A) (B) (Parts) | Formaldehyde added to (A) (C) (Parts) | Total Formaldehyde (B + C) (Parts) | Ratio Formaldehyde to Dimethyloldihydroxyethyleneurea (B + C)/A | Magnesium Chloride-Aluminum Chloride (9:1) (Parts) | Water (Parts) | Fifth Wash Durable Press Rating | Fifth Wash Dimensional Stability (Percent) Warp | Fill | Part Per Million Formaldehyde on treated fabric |
|---|---|---|---|---|---|---|---|---|---|---|---|
| 0.99 | 0.9 | 0.02 | 0.185 | 0.205 | 0.228 | 0.9 | 97.00 | 3.5 | −1.5 | −0.44 | 88 |
| 0.99 | 2.25 | 0.05 | 0.185 | 0.235 | 0.104 | 0.9 | 95.62 | 3.5 | −1.2 | −0.2 | 218 |

TABLE VII-continued

| Softener Example 6(a) (Parts) | Dimethyloldihydroxyethyleneurea (A) (Parts) | Formaldehyde in (A) (B) (Parts) | Formaldehyde added to (A) (C) (Parts) | Total Formaldehyde (B + C) (Parts) | Ratio Formaldehyde to Dimethyloldihydroxyethyleneurea (B + C)/A | Magnesium Chloride-Aluminum Chloride (9:1) (Parts) | Water (Parts) | Fifth Wash Durable Press Rating | Fifth Wash Dimensional Stability (Percent) Warp | Fill | Part Per Million Formaldehyde on treated fabric |
|---|---|---|---|---|---|---|---|---|---|---|---|
| Comparison Examples | | | | | | | | | | | |
| — | — | — | — | — | — | — | 100.00 | 3.0 | −2.8 | −0.5 | 12 |
| — | 0.9 | 0.02 | — | 0.02 | 0.022 | 0.9 | 98.18 | 3.0 | −1.8 | −0.6 | 76 |
| — | 0.9 | 0.02 | 0.185 | 0.205 | 0.228 | 0.9 | 98.00 | 3.5 | −1.3 | −0.6 | 168 |
| 0.99 | 0.9 | 0.02 | — | 0.02 | 0.022 | 0.9 | 97.19 | 3.0 | −1.9 | −0.55 | 79 |
| — | 2.25 | 0.05 | — | 0.05 | 0.022 | 0.9 | 96.80 | 3.5 | −1.55 | −0.4 | 177 |
| — | 2.28 | 0.05 | 0.185 | 0.235 | 0.104 | 0.9 | 96.62 | 3.5 | −1.05 | −0.25 | 296 |
| 0.99 | 2.25 | 0.05 | — | 0.05 | 0.022 | 0.9 | 95.81 | 3.5 | −1.45 | −0.55 | 156 |

EXAMPLE 8

Several compositions are prepared by dispersing the ingredients listed in Table VIII in water. The softener is prepared in accordance with the procedure described in Example 6(a). These formulations are padded onto samples of polyester/cotton (65/35) fabric at 50 percent wet pick-up. The fabric is dried and cured in accordance with the procedure described in Example 1. The treated fabric is then evaluated for (a) parts per million formaldehyde; (b) dimensional stability after five home launderings; (c) durable press properties after five home launderings; and (d) fabric hand. The results of these evaluations show that the presence of an aldehyde in the formulation can enhance the durable press ratings and dimensional stability of the fabric after multiple home launderings while having formaldehyde levels which are acceptable by the textile industry. Furthermore, all fabrics treated with softeners have a soft, silky hand. The results are shown in Table VIII.

EXAMPLE 9

Several compositions are prepared by dispersing the ingredients listed in Table IX in water. The softener is prepared in accordance with the procedure in Example 6(a). These formulations are padded onto polyester/cotton (65/35) fabric at 50 percent wet pick-up. The fabric is dried and cured according to the procedure in Example 1. The treated fabric is then evaluated for (a) parts per million formaldehyde; (b) dimensional stability after five home launderings; (c) durable press properties after five home launderings; and (d) fabric hand. The results of these evaluations show that the presence of formaldehyde in the formulation enhances the durable press ratings and dimensional stability of the fabric after multiple launderings while the fabric contains less than 250 parts per million of formaldehyde. In addition, all fabrics treated with softeners have a soft, silky hand. Furthermore, variations of the amount of acid catalyst present in the formulation has no effect on either of the above results. The results are shown in Table IX.

TABLE VIII

| Softener Example 6(a) (Parts) | Dimethyloldihydroxyethyleneurea (A) (Parts) | Formaldehyde in (A) (B) (Parts) | Formaldehyde added to (A) (C) (Parts) | Acetaldehyde added to (A) (C) (Parts) | Total Aldehyde (B + C) (Parts) | Ratio Aldehyde to Dimethyloldihydroxyethyleneurea (B + C)/A | Magnesium Chloride-Aluminum Chloride (9:1) (Parts) | Water (Parts) | Fifth Wash Durable Press Rating | Fifth Wash Dimensional Stability (Percent) Warp | Fill | Parts Per Million Formaldehyde on treated fabric |
|---|---|---|---|---|---|---|---|---|---|---|---|---|
| 0.99 | 0.9 | 0.02 | 0.185 | — | 0.205 | 0.228 | 0.9 | 97.00 | 3.5 | −1.5 | −0.4 | 88 |
| 0.99 | 0.9 | 0.02 | 0.418 | — | 0.438 | 0.487 | 0.9 | 96.77 | 3.5 | −1.25 | −0.2 | 283 |
| 0.99 | 0.9 | 0.02 | — | 0.185 | 0.205 | 0.228 | 0.9 | 97.00 | 3.5 | −1.5 | −0.4 | 54 |
| 1.32 | 0.9 | 0.02 | — | 0.244 | 0.264 | 0.293 | 0.9 | 96.62 | 3.5 | −1.7 | −0.4 | 35 |
| Comparison Examples | | | | | | | | | | | | |
| — | — | — | — | — | — | — | — | 100.0 | 3.0 | −2.8 | −0.5 | 12 |
| — | 0.9 | 0.02 | — | — | 0.02 | 0.022 | 0.9 | 98.18 | 3.0 | −1.8 | −0.6 | 76 |

TABLE IX

| Softener Example 6(a) (Parts) | methyl-dihy-droxy-ethylene-urea (A) (Parts) | Formal-dehyde in (A) (B) (Parts) | Formal-dehyde added to (A) (C) (Parts) | Total Formal-dehyde (B + C) (Parts) | Ratio Formal-dehyde to Di-methyl-oldihy-droxy-ethyl-eneurea (B + C)/A | Magnesium Chloride-Aluminum Chloride (9:1) (Parts) | Water (Parts) | Fifth Wash Durable Press Rating | Fifth Wash Dimensional Stability (Percent) Warp | Fill | Part Per Million Formaldehyde on treated fabric |
|---|---|---|---|---|---|---|---|---|---|---|---|
| 0.99 | 0.9 | 0.02 | 0.185 | 0.205 | 0.228 | 0.9 | 97.00 | 3.5 | −1.5 | −0.4 | 88 |
| 0.99 | 0.9 | 0.02 | 0.185 | 0.205 | 0.228 | 1.5 | 96.40 | 3.5 | −1.55 | −0.35 | 233 |
| 0.99 | 0.9 | 0.02 | 0.185 | 0.205 | 0.228 | 3.0 | 94.90 | 3.5 | −1.5 | −0.20 | 143 |
| Comparison Examples | | | | | | | | | | | |
| — | — | — | — | — | — | — | 100.0 | 3 | −2.8 | −0.5 | 12 |
| — | 0.9 | 0.02 | — | 0.02 | 0.022 | 0.9 | 98.18 | 3 | −1.8 | −0.6 | 76 |

EXAMPLE 10

Several compositions are prepared by dispersing the ingredients shown in Table X in water. The softener is prepared in accordance with the procedure described in Example 6(a). These compositions are padded onto 100 percent cotton at 50 percent wet pick-up. The fabric is dried and cured in accordance with the procedure described in Example 1. The treated fabric is then evaluated for (a) parts per million formaldehyde; (b) dimensional stability after five home launderings; (c) durable press properties after five home launderings; and (d) fabric hand. The results show that the presence of formaldehyde in a textile finishing composition containing a softener improves dimensional stability and durable press properties of cotton in comparison to that obtained with a composition containing only dimethyldihydroxyethylene urea and a softener. Furthermore, the treated fabric had a soft, silky hand. The results are shown in Table X.

TABLE X

| Softener Example 6(a) (Parts) | Dimethyl-oldihy-droxy-ethylene-urea (A) (Parts) | Formal-dehyde in (A) (B) (Parts) | Formal-dehyde added to (A) (C) (Parts) | Total Formal-dehyde (B + C) (Parts) | Ratio Formal-dehyde to Di-methyl-oldihy-droxy-ethyl-eneurea (B + C)/A | Magnesium Chloride-Aluminum Chloride (9:1) (Parts) | Water (Parts) | Fifth Wash Durable Press Rating | Fifth Wash Dimensional Stability (Percent) Warp | Fill | Part Per Million Formaldehyde on treated fabric |
|---|---|---|---|---|---|---|---|---|---|---|---|
| 0.99 | 1.80 | 0.04 | 0.185 | 0.225 | 0.185 | 1.2 | 95.78 | 2 | −1.8 | +0.6 | 202 |
| 0.99 | 2.25 | 0.05 | 0.185 | 0.235 | 0.104 | 1.2 | 95.32 | 2 | −1.6 | +0.1 | 484 |
| 0.99 | 2.25 | 0.05 | 0.092 | 0.142 | 0.063 | 1.2 | 95.42 | 2 | −1.75 | +0.3 | 146 |
| Comparison Examples | | | | | | | | | | | |
| — | — | — | — | — | — | — | 100.00 | 1 | −6.45 | +0.35 | 4 |
| — | 1.80 | 0.04 | — | 0.04 | 0.022 | 1.2 | 96.96 | 2 | −2.0 | +0.25 | 103 |
| — | 1.80 | 0.04 | 0.185 | 0.225 | 0.125 | 1.2 | 96.78 | 2 | −1.8 | +0.4 | 247 |
| — | 2.25 | 0.05 | — | 0.05 | 0.022 | 1.2 | 96.50 | 2 | −2.0 | −0.2 | 357 |
| — | 2.25 | 0.05 | 0.185 | 0.235 | 0.104 | 1.2 | 96.32 | 2 | −1.8 | 0 | 374 |
| — | 2.25 | 0.05 | 0.092 | 0.142 | 0.063 | 1.2 | 96.41 | 2 | −1.85 | +0.4 | 192 |

What is claimed is:

1. A textile finishing composition comprising (1) a diluent and (2) a durable press resin composition containing (a) an aminoplast resin and (b) an aldehyde in excess of that present in the aminoplast resin in which the durable press resin composition is present in an amount of at least 0.18 percent by weight based on the weight of the diluent and aminoplast resin and the weight ratio of aldehyde to aminoplast resin is from 0.05 to 0.6.

2. The composition of claim 1, wherein the composition contains (3) a softening agent.

3. The textile finishing composition of claim 1, wherein the durable press resin composition is present in an amount of from 0.18 to 72 percent by weight, based on the weight of the diluent and the durable press resin composition.

4. The composition of claim 3, wherein a softening agent is present in the durable press resin composition.

5. The composition of claim 2, wherein the softening agent is a crosslinkable organopolysiloxane.

6. The composition of claim 5, wherein the crosslinkable orgnopolysiloxane contains an organopolysiloxane of the formula

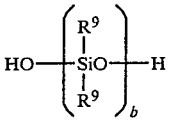

and a crosslinking agent selected from the group consisting of silanes of the formula $$R^9_mSi(Y)_{4-m}$$

and siloxanes having Si—O—Si linkages wherein the unsatisfied valences of the silicon atoms are satisfied by $R^9$ and Y, where $R^9$ is a monovalent hydrocarbon radical having from 1 to 18 carbon atoms, Y is a hydrolyzable group, b is from 1 to 1000, m is 0 or 1 and when the crosslinking agent is a siloxane then an average of at least 3 hydrolyzable groups are present per molecule.

7. The composition of claim 2, wherein the softening agent is an organopolysiloxane of the formula $$R_3^9\text{—SiO}\left(\begin{array}{c}R^9\\ |\\ \text{—SiO—}\\ |\\ R^9\end{array}\right)_b\text{—Si—}R_3^9$$

where $R^9$ is a monovalent hydrocarbon radical having from 1 to 20 carbon atoms and b is from 1 to 1000.

8. The composition of claim 2, wherein the softening agent is a silylated polyether.

9. The composition of claim 2, wherein the softening agent comprises a silylated polyether and a silanol containing organopolysiloxane.

10. The composition of claim 2, wherein the softening agent is an organic softener.

11. A finishing bath containing the textile finishing composition of claim 1 and an acid catalyst.

12. A finishing bath containing the textile finishing composition of claim 2 and an acid catalyst.

13. The finishing bath of claim 11, wherein the diluent is water.

14. The finishing bath of claim 12, wherein the diluent is water.

15. A finishing bath containing (1) from 0.1 to 99 parts by weight of the textile finishing composition of claim 1, (2) from 0.5 to 20 parts by weight per 100 parts by weight of textile finishing composition of an acid catalyst, (3) from 0 to 8 parts by weight per 100 parts by weight of textile finishing composition of softening agent and (4) from 0 to 99.4 parts by weight per 100 parts by weight of textile finishing composition of diluent.

* * * * *